United States Patent [19]

Matsumura et al.

[11] 4,344,399

[45] Aug. 17, 1982

[54] METHOD AND APPARATUS FOR CONTROLLING ENGINE IDLING SPEED

[75] Inventors: Toshimi Matsumura, Ohbu; Norio Omori; Hisamitsu Yamazoe, both of Kariya, all of Japan

[73] Assignee: Nippondenso Co., Ltd., Kariya, Japan

[21] Appl. No.: 186,449

[22] Filed: Sep. 12, 1980

[30] Foreign Application Priority Data

Sep. 14, 1979 [JP] Japan ..... 54-118155

[51] Int. Cl.[3] ..... F02D 9/02; F02D 31/00

[52] U.S. Cl. ..... 123/339; 364/431.07; 364/431.1

[58] Field of Search ..... 123/339, 352, 585; 364/431

[56] References Cited

U.S. PATENT DOCUMENTS

| | | | |
|---|---|---|---|
| 3,964,457 | 6/1976 | Coscia | 123/588 X |
| 4,130,095 | 12/1978 | Bowler et al. | 123/440 |
| 4,203,395 | 5/1980 | Cromas et al. | 123/339 |
| 4,237,833 | 12/1980 | Des Lanriers | 123/339 X |
| 4,240,145 | 12/1980 | Yano et al. | 123/587 X |
| 4,289,100 | 9/1981 | Kinugawa et al. | 123/339 |
| 4,291,656 | 9/1981 | Miyagi et al. | 123/324 X |

*Primary Examiner*—Tony M. Argenbright

*Attorney, Agent, or Firm*—Cushman, Darby & Cushman

[57] ABSTRACT

To control the idling speed of an automotive engine, a control amount is predetermined which determines an idle air flow for providing a basic idling speed and the idle air flow is adjusted in accordance with the control amount. Also, when the engine is idling after the completion of the warm-up operation, in accordance with the difference between a predetermined desired engine idling speed and the actual engine speed attained after the adjustment of the idle air flow in accordance with a basic control amount, a correction value for compensating the basic control amount is computed and memorized such that the actual engine idling speed is adjusted to the desired speed, whereby the idle air flow is adjusted in accordance with the memorized correction value and the basic control amount in all the engine operating conditions including the idling operation.

8 Claims, 5 Drawing Figures

METHOD AND APPARATUS FOR CONTROLLING ENGINE IDLING SPEED

BACKGROUND OF THE INVENTION

The present invention relates to a method and apparatus for controlling the idling speed of an internal combustion engine in accordance with the outputs of sensors for sensing the conditions of the engine.

In the past, with a view to making the idling speed of an engine maintenance free, closed loop (negative feedback) idle control methods have been proposed for always maintaining the idling speed of an engine at a desired speed corresponding to the warm-up condition of the engine.

However, since these prior art methods control the idling speed of an engine so as to always maintain it at a desired value (speed) corresponding to the warm-up condition of the engine irrespective of the will of the driver of the vehicle in which the engine is installed, they still involve many problems. For instance, in the case of the engine of an automobile with a manual transmission, if the foot brakes were applied to the automobile being run during the warm-up to decelerate the automobile and then the clutch was disengaged, since the negative feedback control had been effected and since the idle air flow had been increased due to the actual engine speed being lower than the desired speed, there was the disadvantage of rapidly increasing the engine speed just after the disengagement of the clutch. Moreover, if the clutch was disengaged while the automobile was coasting by the force of inertia, since, due to the negative feedback control and due to the actual engine speed higher than the desired speed, the idle air flow had been decreased extremely so as to decrease the speed, there was the disadvantage of rapidly decreasing the speed upon the disengagement of the clutch and thus causing the engine to stall in the worst case. On the other hand, where the engine cooling water temperature was low with the engine still being at the warm-up operation and the desired engine speed was higher than the actual engine speed, even if the throttle valve was not opened or the accelerator pedal was not yet depressed by the driver, if the transmission was being engaged, due to the operation of increasing the actual engine speed to the desired speed there was the disadvantage of increasing the vehicle speed against the will of the driver or making it impossible to obtain the desired engine braking effect.

SUMMARY OF THE INVENTION

With a view to overcoming the foregoing deficiencies in the prior art, it is the object of the present invention to provide an improved idle speed control method and apparatus so designed that there is preliminarily established a control amount for determining an idle air flow which in turn provides a basic idling speed and in accordance with the control amount the idle air flow is adjusted so as to control the idling speed,. and the method and apparatus of this invention feature in that during the idling operation after the engine has warmed up, in accordance with the difference between a predetermined desired idling speed and the actual idling speed attained after adjusting the idle air flow according to a basic control amount, a correction value for compensating the basic control amount is computed and memorized such that the actual idling speed is adjusted to the desired idling speed and the idle air flow is adjusted in accordance with the memorized correction value and the basic control amount under all the operating conditions of the engine including the idling operation. In other words, only during the idling operation after the engine has warmed up, a desired idling speed is established so that negative feedback control is accomplished and a correction value is obtained in accordance with the difference between the desired speed and the actual engine speed, thus eliminating the problem of a rapid change in the speed upon disengaging the clutch of the manual transmission while the vehicle is running and the problem of increasing the vehicle speed during the warm-up operation against the wall of the driver and adjusting the idle air flow in accordance with the correction value during the other operating conditions making the idling speed maintenance free.

DESCRIPTION OF THE PREFERRED EMBODIMENT

The present invention will now be described in greater detail with reference to the illustrated embodiment.

Figure 1:
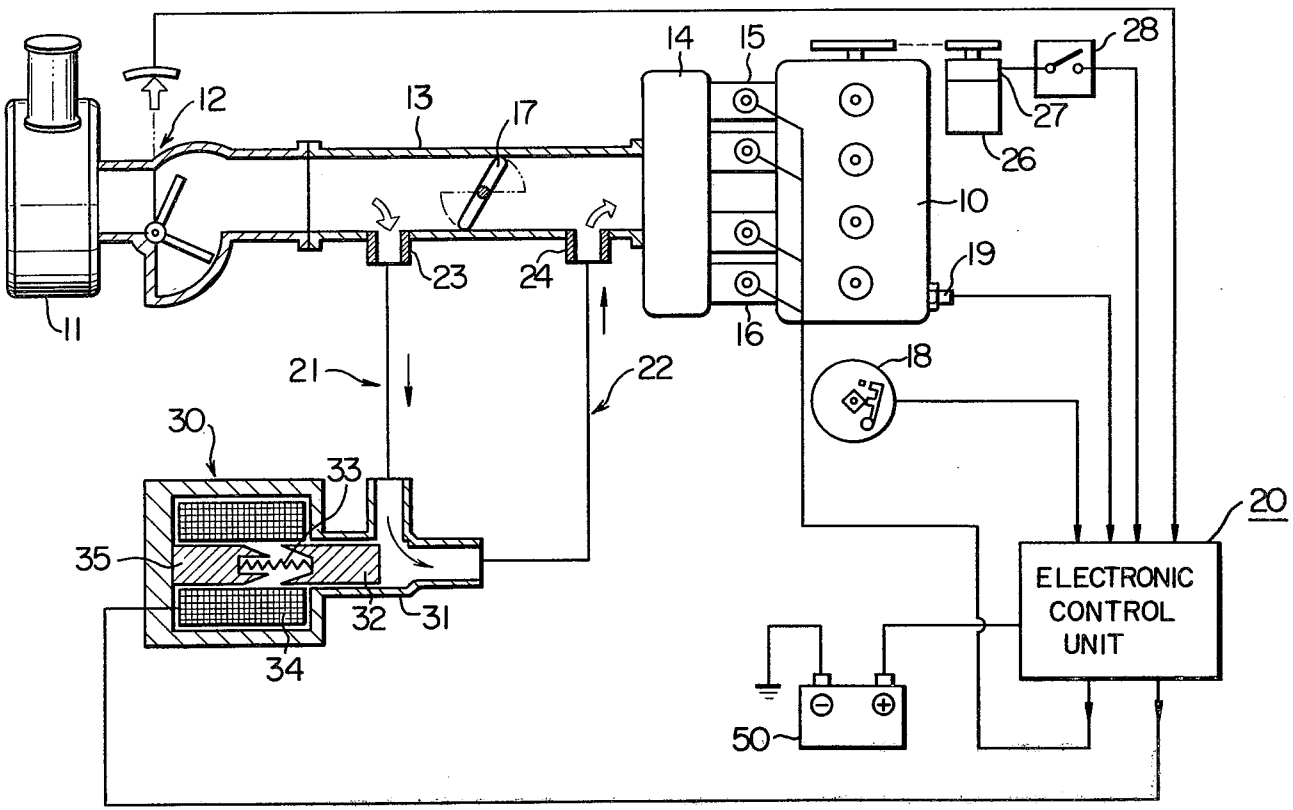
FIG. 1 is a schematic diagram showing the construction of an embodiment of the invention.

Referring first to FIG. 1, an engine 19 is a known type of four-cycle spark-ignition engine for automotive vehicles of the type including as engine loads an air conditioner system and an automatic transmission. The engine 10 draws an air by way of an air cleaner 11, an air flow meter 12, an intake pipe 13, a surge tank 14 and intake branches 15, and fuel such as gasoline is injected into the engine 10 by electromagnetic fuel injection valves 16 which are mounted in the respective intake branches 15.

The primary air flow to the engine 10 is adjusted by a throttle valve 17 which can be operated as desired, and the amount of fuel injected into the engine 10 is adjusted by an electronic control unit 20. The electronic control unit 20 determines the fuel injection amount in a conventional manner in accordance with the basic parameters including the engine speed measured by an engine speed sensor 18 incorporated in the distributor of the ignition system and the amount of air flow measured by the air flow meter 12, and as is well known the fuel injection amount is also varied in response to the signals from other sensors including a warm-up sensor 19 comprising a water temperature sensor for detecting the cooling water temperature, etc.

Air pipes 21 and 22 are arranged to bypass the throttle valve 17, and an air control valve 30 is connected between the pipes 21 and 22. The other end of the pipe 21 is connected to an air inlet 23 positioned between the throttle valve 17 and the air flow meter 12, and the other end of the pipe 22 is connected to an air outlet 24 positioned downstream of the throttle valve 17.

The air control valve 30 is basically a proportional solenoid (linear solenoid) type control valve in which the air passage area between the air pipes 21 and 22 is continuously and linearly varied in response to the displacement of a plunger 32 which is slidable within a housing 31. Usually the plunger 32 is set by a compressed spring 32 so that the air passage area is reduced to zero.

When current is supplied to a solenoid 34, an electromagnetic attraction acts between the plunger 32 and a core 35 and the plunger 32 is moved toward the core 35 in dependence on the average value of the current supplied.

In this way, the distance between the plunger 32 and the core 35 of the air control valve 30 is varied in dependence on the amount of current supplied to the solenoid 34, making it possible to continuously vary the air passage area between the air pipes 21 and 22 and thereby to control the amount of air flow in dependence on the value of current supplied.

As in the case of the fuel injection valves 16, the operation of the solenoid 34 is controlled by the electronic control unit 20. In addition to the signal from the engine speed sensor 18 and the warm-up sensor 19, the electronic control unit 20 is supplied with various signals such as the signal from an air conditioner switch 28 for turning on and off an electromagnetic clutch 27 which engages and disenges the engine drive shaft with a compressor 26 for a vehicle air conditioner.

Figure 2:
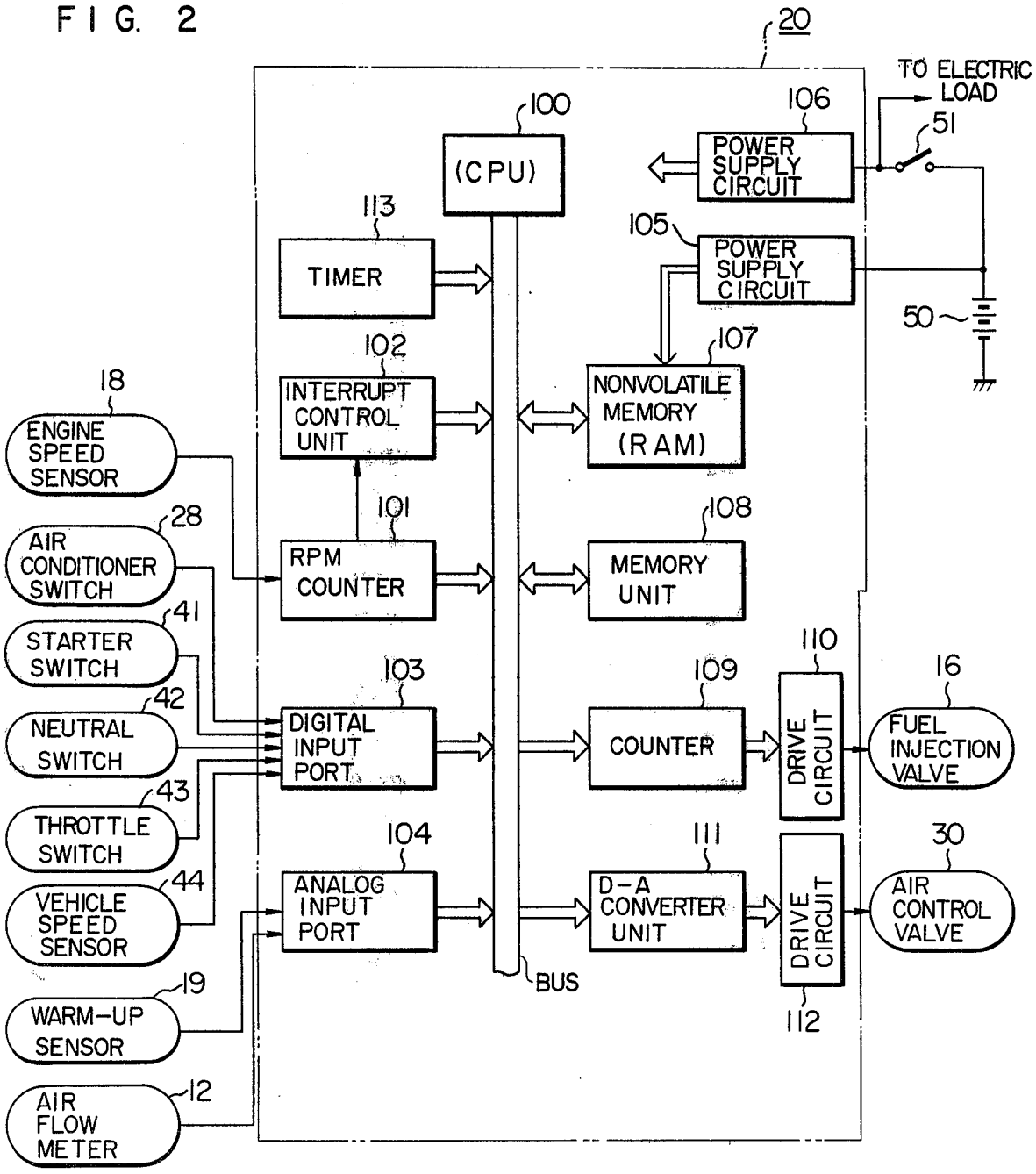
FIG. 2 is a block diagram of the electronic control unit shown in FIG. 1.

Next, the electronic control unit 20 will be described with reference to FIG. 2. In the Figure, numeral 100 designates a microprocessor (CPU) for respectively computing the desired fuel injection amount and the desired idle air flow as the valve opening duration of the fuel injection valves 16 and the displacement (or the average supplied current) of the solenoid 34 of the air control valve 30. Numeral 101 designates an RPM counter responsive to the signal from the engine speed (RPM) sensor 18 to sense the number of engine revolutions. The RPM counter 101 also applies an interrupt command signal to an interrupt control unit 102 in synchronism with the rotation of the engine. When the interrupt command signal is received, the interrupt control unit 102 supplies an interrupt request signal to the microprocessor 100 through a common bus 150 and the microprocessor 100 is caused to perform in a conventional manner such operations as the computation of the fuel injection amount, etc. Numeral 103 designates a digital input port for receiving, in addition to the signal from the air conditioner switch 28, the signal from a starter switch 41 for turning on and off the operation of the starter which is not shown, the signal from a neutral switch 42 for sensing whether the vehicle automatic transmission is in the neutral position, the signal from a throttle switch 43 for sensing whether the throttle valve 17 is in the full-closed portion (or the idle position) and the signal from a vehicle speed sensor 44 for sensing whether the vehicle is at a zero speed (or whether the vehicle is stopping) and supplying these digital signals to the microprocessor 100. Numeral 104 designates an analog input port comprising an analog multiplexer and an A-D converter such that the signal from the warm-up sensor 19 for sensing the cooling water temperature and the signal from the air flow meter 12 for sensing the amount of air flow to the engine (or its suction air amount) are sequentially subjected to the A-D conversion and they are then supplied to the microprocessor 100. The output data of these units 101, 102, 103 and 104 are transferred to the microprocessor 100 through the common bus 150. Numeral 50 designates a battery, and 51 a key switch. A power supply circuit 105 is connected to the battery 50 directly and not through the key switch 51 so as to supply power to a nonvolatile memory or RAM 107. As a result, the power is always applied to the RAM 107 irrespective of the key switch 51. Numeral 106 designates another power supply circuit connected to the battery 50 through the key switch 51. The power supply circuit 106 supplies the power to all the component parts except the RAM 107. The nonvolatile memory or RAM 107 forms a temporary memory unit which is used temperarily while the program is in operation and it is so designed that the power is always supplied to it independently of the key switch 51 as mentioned previously and thus its stored contents will not be lost even if the key switch 51 is turned off thus stopping the operation of the engine. The RAM 107 stores the correction values R ($R_1$, $R_2$, $R_3$, $R_4$) which will be described later. Numeral 108 designates a memory unit comprising a read-only memory (ROM) for storing a program and various constants and a read/write memory for temporarily storing the data while the program is in operation (during the computational operations). Numeral 109 designates a fuel injection time controlling counter in the form of a down counter including a register, whereby the digital signal computed by the microprocessor or CPU 100 and indicative of the valve opening duration or the fuel injection amount of the electromagnetic fuel injection valves 16 is converted to a pulse signal having a pulse width which determines the actual valve opening duration of the fuel injection valves 16. Numeral 110 designates an amplifier circuit for driving the electromagnetic fuel injection valve. Numeral 111 designates a D-A converter unit for controlling the amount of idle air flow, which is designed so that the control amount I signal computed by the microprocessor 100 and indicative of the amount of current flow to the solenoid means 34 which determines the opening of the air control valve 30 or the amount of idle air flow, is converted to an analog quantity and this analog signal is amplified by a known type of drive circuit 112 to operate the air control valve 30. Numeral 113 designates a timer for measuring the elapsed time and transferring the same to the CPU 100. The RPM counter 101 is responsive to the output of the engine speed sensor 18 to measure the engine rotational speed once for every engine revolution and an interrupt command signal is supplied to the interrupt control unit 102 upon completion of each speed measurement. In response to the applied signal, the interrupt control unit 102 generates an interrupt request signal so that the microprocessor 100 executes the interrupt handling routine for computing the amount of fuel injected.

Figure 3:
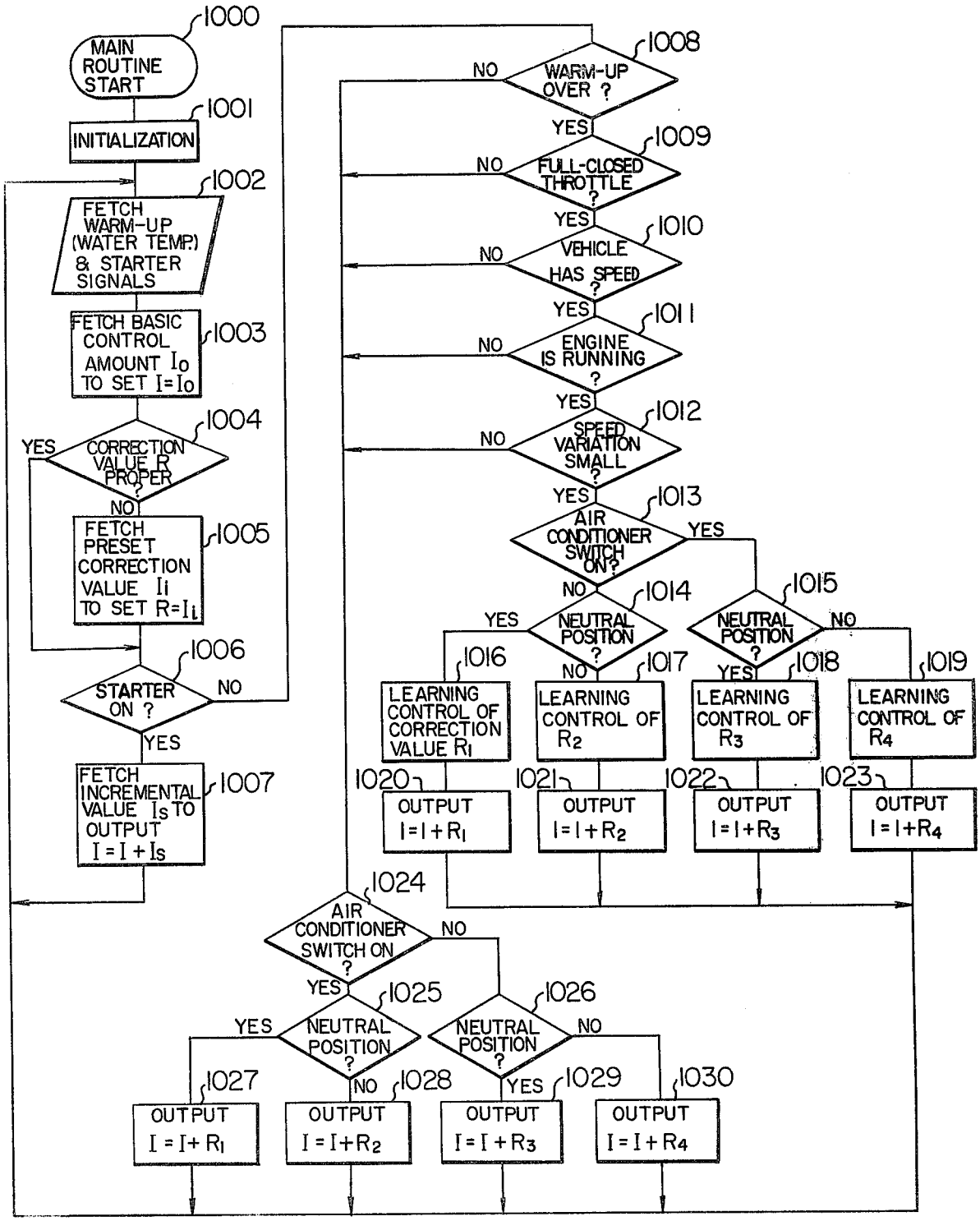
FIG. 3 is a flowchart showing the function of the principal components of the microprocessor shown in FIG. 2.
Figure 4:
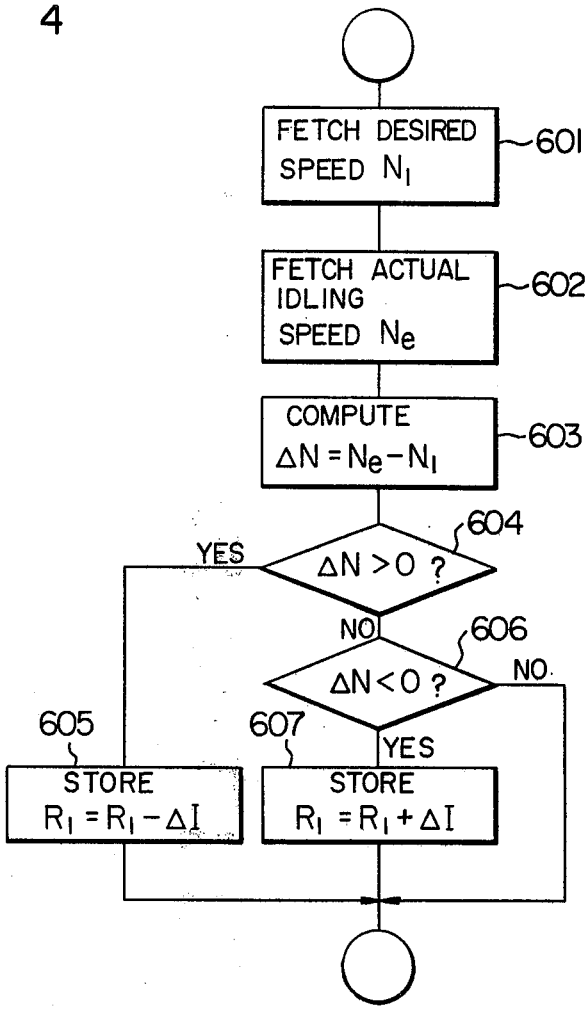
FIG. 4 is a detailed flowchart for the principal parts of the flowchart shown in FIG. 3.
Figure 5:
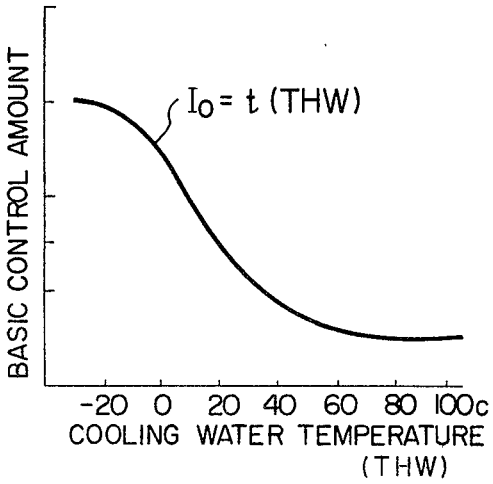
FIG. 5 is a characteristic diagram useful for explaining the invention.

FIG. 3 illustrates a brief flowchart showing the processing steps of the microprocessor 100 for computing the amount of idle air flow, and the function of the microprocessor 100 as well as the operation of the entire apparatus of the invention will now be described with reference to this flowchart. When the key switch 51 and the starter switch 41 are turned on so that the engine is started, the computational operation of the main routine is started by the starting action of a first step 1000 so that a step 1001 performs the initialization process and then a step 1002 reads in the digital value corresponding to the cooling water temperature signal generated by the warm-up sensor 19 and applied through the analog input port 104. The next step 1003 reads in from the associated area of the memory unit 108 a basic control amount $I_0$ corresponding to the water temperature digital value as shown by the characteristic diagram of FIG. 5 (or the basic control amount which determines the amount of current flow to the solenoid 34 of the air control valve 30) and changes the control amount I to $I=I_0$. Then, a step 1004 determines whether the correction amounts R ($R_1$, $R_2$, $R_3$, $R_4$) stored in the nonvolatile memory 107 are proper, that is, whether the correction amounts R are within a predetermined range of values, so that if the values are not proper, the control is transferred to a step 1005 and the values $R_1$, $R_2$, $R_3$ and $R_4$ of the correction amounts R in the nonvolatile memory 107 are replaced by predetermined initial correction values (fixed values) $I_i$ ($I_1$, $I_2$, $I_3$, $I_4$). When the correction values R are proper or when the replacing process of the step 1005 is completed, the control is transferred to a step 1006 which determines whether the engine starter has been operated, that is, whether the starter switch 41 has been turned on is determined in accordance with the signal from the starter switch 41. If the starter has been operated, the control is transferred to a step 1007 so that in order to provide the required engine starting air flow, a starting air flow incremental value $I_s$ is added to the control amount I computed by the step 1003 and the resulting control amount $I=I+I_s$ is applied to the D-A converter unit 111. If the starter has been turned off, the control is transferred to a step 1008 which determines whether the engine warm-up operation has been completed, or whether the cooling water temperature is higher than a predetermined temperature is determined in accordance with the cooling water temperature information from the warm-up sensor 19. If the warm-up operation is over, the control is transferred to a step 1009 which determines whether the throttle valve is in the full-closed position, that is, whether the throttle valve is in the idle position is determined in accordance with the signal from the throttle switch 43. If the throttle valve is in the full-closed position, the control is transferred to a step 1010 which determines whether the vehicle is at a zero speed, that is, whether the vehicle is at rest or running is determined in accordance with the signal from the vehicle speed sensor 44. If the vehicle is at rest, the control is transferred to a step 1011 which determines whether the engine is in operation or at rest, that is, whether the rotational speed Ne is higher than a predetermined value is determined in accordance with the output or engine speed (RPM) signal Ne from the RPM counter 101. If the engine does not stall, the control is transferred to a step 1012 which determines whether the variation of the engine speed is less than a predetermined value, that is, whether the difference between the current engine speed and the engine speed sensed a predetermined number of cycles or predetermined time interval before is less than a predetermined value is determined in accordance with the engine speed Ne signal. If the variation of the engine speed is small, that is, when the determination conditions of the steps 1008 to 1012 are all satisfied and when it is considered that the engine is idling stably, the control is transferred to a step 1013 which determines whether the air conditioner switch 28 is on or the air conditioner compressor 26 is connected as the engine load. Steps 1014 and 1015 are such that whether the vehicle automatic transmission is in the neutral position is determined in accordance with the signal from the transmission neutral switch 42, that is, whether the transmission is connected as the engine load is determined. If the air conditioner switch 28 is off and the transmission is in the neutral position, that is, if there is a first condition where both the air conditioner compressor and the automatic transmission are not functioning as the engine loads, the control is transferred to a step 1016 so that the correction value $R_1$ of the correction values R corresponding to the first condition is corrected and stored. In other words, the correction value $R_1$ is controlled by learning. This learning control will be explained with reference to the flowchart of FIG. 4, in which a step 601 fetches a predetermined desired idling speed $N_1$ in response to the first engine load condition, and a step 602 fetches the actual idling speed Ne. The next step 603 computes the difference $\Delta N$ between the actual speed Ne and the desired speed $N_1$ or $\Delta N=Ne-N_1$, and the next step 604 determines whether the resulting difference $\Delta N$ is positive. If the difference $\Delta N$ is positive, the control is transferred to a step 605 so that since the actual speed Ne is higher than the desired speed $N_1$, the correction value $R_1$ is decreased by a predetermined compensation amount $\Delta I$ so as to decrease the actual speed or to decrease the amount of idle air flow and the resulting $R_1=R_1-\Delta I$ is stored as a new correction value $R_1$ in the nonvolatile memory 107. If the difference $\Delta N$ is not positive, the control is transferred to a step 606 which determines whether the $\Delta N$ is negative. If the $\Delta N$ is negative, the control is transferred to a step 607 so that in accordance with the reverse logic to the processing of the step 605 a correction value $R_1=R_1+\Delta I$ is computed and the resulting new correction value $R_1$ is stored in the nonvolatile memory 107. If the step 606 determines that the $\Delta N$ is not negative, the correction value $R_1$ is not renewed. The learning control operation performed on the correction value $R_1$ by the step 1016 has been described in detail. After the operation of the step 1016 has been completed, the control is transferred to a step 1020 so that the newly computed correction value $R_1$ is used to compute a control amount $I=I+R_1$ ($=I_0+R_1$) and the resulting control amount I is supplied to the D-A converter unit 111.

If the steps 1013, 1014 and 1015 determine that there exists a second load condition where the air conditioner switch 28 is off and the automatic transmission is in the drive position and not in the neutral position, the control is transferred to a step 1017 so that the correction value $R_2$ of the correction values R corresponding to the second condition is corrected and stored. The correcting operation of the correction value $R_2$ by the step 1017 is performed in the same manner as the previously mentioned step 1016, that is, the correction is effected by computing $R_2=R_2\pm\Delta I$ in accordance with the difference between the actual idling speed Ne and a predetermined desired idling speed $N_2$ corresponding to the second engine load condition. Then, the control is transferred to a step 1021 so that in accordance with the newly computed correction value $R_2$ a control amount $I=I+R_2$ is computed and generated.

If the steps 1013, 1014 and 1015 determine that there is a third load condition where the air conditioner switch 28 is on and the automatic transmission is in the neutral position, the control is transferred to a step 1018 so that the correction value $R_3$ of the correction values R corresponding to the third condition is corrected and stored. The correcting operation of the step 1018 is performed in the same manner as in the case of the steps 1016 and 1017, that is, the correction value $R_3$ is corrected by computing $R_3=R_3\pm\Delta I$ in accordance with the difference between the actual idling speed Ne and a desired idling speed $N_3$ corresponding to the third engine load condition. Then, the control is transferred to a step 1022 so that in accordance with the newly computed correction value $R_3$ a control amount $I=I+R_3$ is computed and generated.

If the steps 1013, 1014 and 1015 determine that there is a fourth load condition where the air conditioner switch 28 is on and the automatic transmission is in the drive position and not in the neutral position, the control is transferred to a step 1019 so that the value $R_4$ of the correction values R corresponding to the fourth condition is corrected and stored. The step 1019 performs the correcting operation of the correction value $R_4$ in the same manner as in the case of the previously mentioned steps 1016, 1017 and 1018, that is, the correction value $R_4$ is corrected by computing $R_4=R_4\pm\Delta I$ in accordance with the difference between the actual idling speed Ne and a predetermined desired idling speed $N_4$ corresponding to the fourth engine load condition. Then, the control is transferred to a step 1023 so that in accordance with the newly computed correction value $R_4$ a control amount $I=I+R_4$ is computed and generated. In the present embodiment, the desired speed $N_4$ corresponding to the fourth condition is selected to have the same value with the desired speed $N_2$ predetermined in correspondence with the second condition. The correction values $R_1$, $R_2$, $R_3$ and $R_4$ and the initial correction values $I_1$, $I_2$, $I_3$ and $I_4$ which were explained in connection with the step 1015 respectively correspond to the correction values $R_1$, $R_2$, $R_3$ and $R_4$ which were explained in connection with the operation of the steps 1016, 1017, 1018 and 1019, respectively.

If the steps 1008, 1009, 1010, 1011 and 1012 determine that the engine is warming up, the throttle valve is open, the vehicle is running (or has a speed), the engine is at rest or the speed variation of the engine is large, that is, if it is considered that the engine is not in the stable condition or the idling condition, the control is transferred to a step 1024 and the correction value R ($R_1$, $R_2$, $R_3$, $R_4$) is not corrected. In the completely same manner as in the case of the steps 1013, 1014 and 1015, the steps 1024, 1025 and 1026 determine whether the air conditioner switch 28 is on and whether the automatic transmission is in the neutral position. Thus, if it is determined that there exists the first engine load condition as in the previously mentioned case, the control is transferred to a step 1027 so that the correction value $R_1$ corresponding to the first condition is fetched from the nonvolatile memory 107 and a control amount $I=I+R_1$ ($=I_0+R_1$) is computed and applied to the D-A converter unit 111. If it is determined that there exists the second engine load condition, the control is transferred to a step 1028 so that in accordance with the correction value $R_2$ corresponding to the second condition a control amount $I=I+R_2$ is computed and generated. On the other hand, if the existence of the third engine load condition is determined, the control is transferred to a step 1029 so that in accordance with the correction value $R_3$ corresponding to the third condition a control amount $I=I+R_3$ is computed and generated. If it is determined that there exists the fourth engine load condition, the control is transferred to a step 1030 so that in accordance with the correction value $R_4$ corresponding to the fourth condition a control amount $I=I+R_4$ is computed and generated. In other words, in the processing of the steps 1027, 1028, 1029 and 1030, the control amount I for determining the idling speed or the idle air flow is determined in accordance with the basic control amount $I_0$ predetermined in correspondence with the warm-up condition of the engine and the correction value R ($R_1$, $R_2$, $R_3$, $R_4$) subjected to the learning control in the processing of the steps 1016 to 1019, and consequently no feedback control is performed as to whether there exists any deviation of the actual idling speed Ne from the desired idling speed.

When the operation of any one of the steps 1007, 1020, 1021, 1022, 1023, 1027, 1028, 1029 and 1030 is completed, the control is returned to the step 1002 and the above-mentioned processing is repeated.

Although the routine for computing the fuel injection amount (or the fuel injection time) of the fuel injection valves 16 is well known and will not be described in detail, the air flow meter 12 detects the overall air flow including the idle air flow supplied through the air control valve 30 so that each time an interrupt request signal is applied to the CPU 100 from the interrupt control unit 102, in response to the air flow signal from the air flow meter 12 the CPU 100 computes the fuel injection amount and the computation result is supplied to the fuel injection time controlling counter 109. As a result, the fuel injection valves 16 inject the fuel in an amount that suits the air flow.

While the above-mentioned embodiment has been described as applied to the engine equipped with a fuel injection system, the present invention is also applicable to engines having the carburetor in which case the air control valve 30 may be replaced with an actuator for controlling the opening of the throttle valve and the operation of the actuator may be controlled in accordance with the control amount I as described previously.

We claim:

1. In a method of controlling the idling speed of a throttle valve equipped engine of an automobile having an air conditioner system and a transmission, including the steps of preliminarily establishing a control amount which determines an idle air flow for providing a basic idling speed and adjusting said idle air flow in accordance with said control amount, the improvement comprising the steps of:

computing said control amount from a basic control amount and a variable correction value being maintained to a constant value during the warm-up of the engine;

computing a difference value between a target idle speed and an actual idle speed of the engine, computing the correction value from the difference value so that the actual idle speed is adjusted to the target idle speed, memorizing the computed correction value and computing the control amount from the memorized correction value and the basic control amount after the termination of warm-up of the engine; and adjusting said idle air flow in accordance with said memorized correction value and said basic control amount under all the operating conditions of said engine including the idling operation thereof.

2. A method according to claim 1, wherein said memorizing step comprises:

sensing a warm-up operating condition of said engine;

sensing a position of said throttle valve upon completion of said warm-up operation;

sensing a vehicle speed of said automobile when said throttle valve is in a full-closed position thereof;

sensing a rotational speed of said engine when said vehicle speed is zero; and sensing a variation in the speed of said engine when said engine has a rotational speed.

3. A method according to claim 2, further comprising the steps of:

sensing an operation of said air conditioner system when said engine speed variation is small;

sensing a position of said transmission when said air conditioner system is not in operation; and computing and memorizing a correction value when said transmission is in a neutral position thereof.

4. A method according to claim 1 which further comprises the steps of discriminating whether said correction value is correct or not, and returning said correction value to an initial value when said correction value is not correct.

5. A method according to claim 1 which further comprises the steps of discriminating whether a starter starting the engine is on or off, and adding a preset value to said control amount when the starter is on.

6. A method according to claim 1 which further comprises the steps of detecting the temperature of the engine, and varying said control amount in accordance with the detected temperature of the engine.

7. In an apparatus for controlling the idling speed of an engine having speed sensor means for sensing a rotational speed of said engine, temperature sensor means for sensing a temperature of said engine, electronic control means responsive at least to output signals of said speed sensor means and said temperature sensor means to generate a control amount signal for controlling an idle air flow to said engine, and air control valve means responsive to said control amount signal from said control means so as to control said idle air flow, the improvement wherein said control means includes:

digital input port means for receiving the output signal of said speed sensor means;

analog input port means for receiving the output signal of said temperature sensor means;

microprocessor means responsive to output information of said digital input port means and said analog input port means for computing a control amount which consists of a basic control amount and a correction value;

memory means for storing said control amount computed by said microprocessor means and supplying desired information to said microprocessor, said basic control amount being preset into said memory means when, in accordance with the output signal of said temperature sensor means, it is determined that said engine is at a warm-up operation, and said correction value being stored in said memory means when the engine has warmed up completely, and rewritten in accordance with the difference value between a target value and the actual rotational speed of the engine; and means for converting a digital output of said microprocessor relating to said idle air flow to operate said air control valve means.

8. An apparatus according to claim 7, wherein said memory means includes a nonvolatile memory backed up by a power supply for storing said correction value, a read only memory for storing a program, and a read/-write memory for temporarily data while the program is being executed.

* * * * *